US005331799A

United States Patent [19]

Weeger

[11] Patent Number: 5,331,799

[45] Date of Patent: * Jul. 26, 1994

[54] SYSTEM FOR CUTTING ROVING IN A SPINNING MACHINE

[75] Inventor: Hans-Peter Weeger, Hattenhofen, Fed. Rep. of Germany

[73] Assignee: Zinser Textilmaschinen GmbH, Ebersbach/Fils, Fed. Rep. of Germany

[ * ] Notice: The portion of the term of this patent subsequent to Jun. 2, 2009 has been disclaimed.

[21] Appl. No.: 911,990

[22] Filed: Jul. 10, 1992

[30] Foreign Application Priority Data

Jul. 10, 1991 [DE] Fed. Rep. of Germany ..... 4122810

[51] Int. Cl.[5] ..... D01H 9/14

[52] U.S. Cl. ..... 57/278; 57/267; 57/299

[58] Field of Search ..... 57/115, 116, 117, 264, 57/267, 276, 278, 281, 299

[56] References Cited

U.S. PATENT DOCUMENTS

| | | | |
|---|---|---|---|
| 806,016 | 11/1905 | Spence | 57/115 |
| 3,643,415 | 2/1972 | Mackie | 57/117 |
| 3,681,905 | 8/1972 | Furtmeier et al. | 57/299 |
| 4,015,416 | 4/1977 | Mori et al. | 57/278 |
| 4,196,575 | 4/1980 | Novak | 57/267 |
| 4,313,299 | 2/1982 | Günkinger et al. | 57/267 |
| 4,805,352 | 2/1989 | Grassle et al. | 57/267 |
| 4,870,815 | 10/1989 | Marchiori et al. | 57/299 |
| 5,117,621 | 6/1992 | Feichtinger et al. | 57/278 |

FOREIGN PATENT DOCUMENTS

| | | | |
|---|---|---|---|
| 428826 | 5/1991 | European Pat. Off. | 57/299 |
| 3929821 | 3/1991 | Fed. Rep. of Germany . | |
| 2303104 | 10/1976 | France . | |

*Primary Examiner*—Daniel P. Stodola
*Assistant Examiner*—Michael R. Manson
*Attorney, Agent, or Firm*—Herbert Dubno; Andrew Wilford

[57] ABSTRACT

After forming a package on a spindle from a roving fed to the spindle through a rotatable flyer finger, feed of the roving is stopped to arrest the flyer in a position with the finger anywhere on the package underneath the upper end of the last layer of turns formed on the package. The package is then lowered until the finger is above the upper end of the last layer of the turns formed on the package while the package is rotated in a reverse direction opposite to the forward direction without feeding more roving to the package. The package is rotated in the forward direction through at least one half revolution about the axis without feeding more roving to the package so as to form at least a partial loop of the roving around the package above the upper end of the last layer of the turns and then more roving is fed to the package while same is lowered until the finger is below the upper end of the last layer of the turns. Finally the package is raised to sever the roving upstream of the package.

2 Claims, 2 Drawing Sheets

SYSTEM FOR CUTTING ROVING IN A SPINNING MACHINE

FIELD OF THE INVENTION

The present invention relates to a spinning machine. More particularly this invention concerns a system for cutting the roving for changing spools in a spinning machine.

BACKGROUND OF THE INVENTION

When a roving package is unloaded from a flyer-type spinner the roving is cut and a tail is left hanging from the guide or applicator finger of the flyer. The trailing end is pressed against the package so that it clings there and with luck does not come loose as the package is moved off to the next production step. The strand tail dangling from the guide finger is pressed against the side of the next spool loaded into the flyer for forming the next package. During the winding operation the flyer normally reciprocates vertically through a continuously shorter stroke so as to form on the spool successive layers each slightly shorter than the underlying one, giving the finished package frustoconically tapered upper and lower ends, although it is possible to achieve this package shape otherwise, for instance with constant-length strokes but with a slight vertical translatory movement to the vertically reciprocating spool.

In commonly owned U.S. Pat. No. 5,117,621 of myself and G. Feichtinger a system is described where the spinning apparatus winds a strand onto a yarn package by relatively rotating a flyer and the yarn package about an upright axis so as to wind the strand in a succession of turns around the package by a flyer finger movable axially relative to the package. Each successive layer of turns has a lower upper end than the preceding one so that the finished package has an axially upwardly tapered upper end. After substantially completely forming the package the rotation is generally stopped to leave the flyer in a position with the finger below the upper end of the last layer of turns formed on the package. Then the package and finger are relatively axially moved until the finger is generally at the upper end of the first layer of turns formed on the package. The flyer and package are then relatively rotated forward, that is in the same direction as when the package was being formed, through at least one half revolution about the axis so as to form a loop of the strand around the upwardly tapered upper package end. Slack is then created in the strand upstream of the package and the finger is moved downward below the level of the upper end of the outer layer. Finally the strand is cut below the level of the upper end of the outer layer.

This action leaves on the package an easily accessible loop formed by the trailing end of the roving wound on the package, making subsequent use of the package easy. In addition a short piece of the leading end of the unspun roving is left hanging from the free end of the flyer finger, making it easy to apply it to the next spool to form another package. The disadvantage of the method of the '621 patent is that it must be carried out at a particular time, when the applicator finger of the flyer is immediately below the upper end of the last-applied turn. Thus a package cannot be wound to an exact weight or filament length.

OBJECTS OF THE INVENTION

It is therefore an object of the present invention to provide an improved system for severing roving in a preparatory spinning or roving machine.

Another object is the provision of such an improved system for severing roving in a prespinning machine which overcomes the above-given disadvantages, that is which allows the spinning to be stopped and the packages to be doffed at any time.

SUMMARY OF THE INVENTION

The instant invention is an improvement on a standard method of operating a spinning apparatus for winding a roving onto a roving package wherein roving is fed to a flyer, the package is rotated in a forward direction about an upright axis, the roving is wound in a succession of turns around the package from a radial innermost first layer to a radial outermost last layer by a flyer finger movable axially relative to the package, and the package and the flyer are relatively vertically displaced such that each successive layer of turns has an upper end that is below the upper end of the preceding layer to impart to the finished package an axially upwardly tapered upper end portion. According to the invention after substantially completely forming the package the drive for the relative rotation of the flyer and the package about the axis is stopped. Then feed of the roving is stopped to arrest the flyer in a position with the finger anywhere on the package underneath the upper end of the last layer of turns formed on the package. The package is then lowered until the finger is above the upper end of the last layer of the turns formed on the package while the package is rotated in a reverse direction opposite the forward direction without feeding more roving to the package. The package is then rotated in the forward direction through at least one half revolution about the axis without feeding more roving to the package so as to form at least a partial loop of the roving around the package above the upper end of the last layer of the turns and then more roving is fed to the package while same is lowered until the finger is below the upper end of the last layer of the turns. Finally the package is raised and, if desired, also rotated forward to sever the roving upstream of the package.

Reverse rotating the roving package during dropping of the spindle bank carrying it unwinds spun slubbing from the roving package to make up for the greater distance between the last-applied turn and the applicator finger. This prevents that as the package moves down an indeterminate number of turns are drawn off or that the slubbing is torn.

The momentary feeding of roving during the inventive method, typically done by the drawing frame that stretches the roving upstream of the prespinning machine, ensures that the slubbing will be severed in the region of the cylindrical portion of the package, thereby leaving an easy-to-handle tail for the next production step, for instance in a ring-spinning machine.

According to a further feature of the inventions after cutting the roving, the package is tipped outward into a doffing position and simultaneously rotated in the forward direction through at least 5°. This further forward rotation of the roving package during lowering of it prevents the applicator finger from contacting and engaging the yarn end lying against the side of the package.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
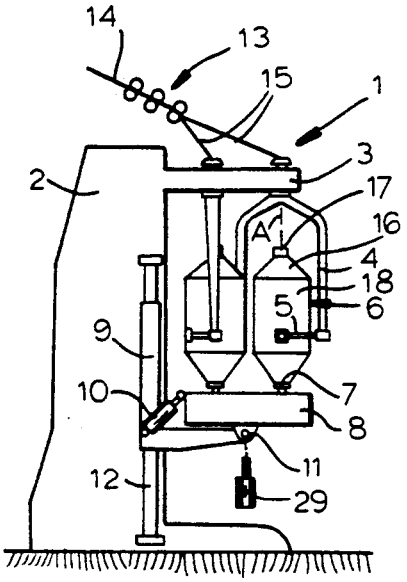
FIGS. 1 through 6 are mainly diagrammatic side views illustrating successive steps of the method of this invention.

As seen in FIGS. 1 through 6 a housing 2 of a preparatory spinning or roving machine 1 has a drawing frame 13 feeding a bank 3 of flyers 4 that are suspended centered on respective vertical axes A of respective yarn packages 6. Each flyer 4 is hollow and had a respective presser-type applicator or guide finger 5 through which a twisted roving or slubbing 15 is fed to the respective package 6. The package 6 is formed as a basically cylindrical body 18 of the filament wound on a tubular core sleeve 17 fitted over a respective spindle 7 and having frustoconical upper and lower ends 16 (see FIG. 7) created as described below.

The housing 2 is provided with a vertical guide 12 on which a support 9 is vertically displaceable by means of an actuator shown schematically at 29. The spindles 7 of the packages 6 are carried on a base 8 pivotal about a horizontal axis 11 on the support 9, and a small hydraulic or pneumatic ram 10 is provided to effect the desired angular positioning for doffing and donning the packages 6 as described in commonly owned U.S. Pat. No. 4,805,382. A drive motor indicated schematically at 31 can rotate the flyers 4 forward as indicated by arrow 27 (FIG. 5) and backward as indicated by arrow 26 (FIG. 2), another drive motor indicated schematically at 30 can rotate the spindles 7, and the actuator 29 can vertically move the base 8 downward as indicated by arrow 22 (FIGS. 2 and 5) and upward as indicated by arrow 24 (FIG. 5) to relatively axially displace the flyers 4 and the respective packages 6. A controller 28 operates the drive means 10, 29, 30, and 31 as well as a reversible drive motor 32 for the drawing frame 13.

Figure 6:
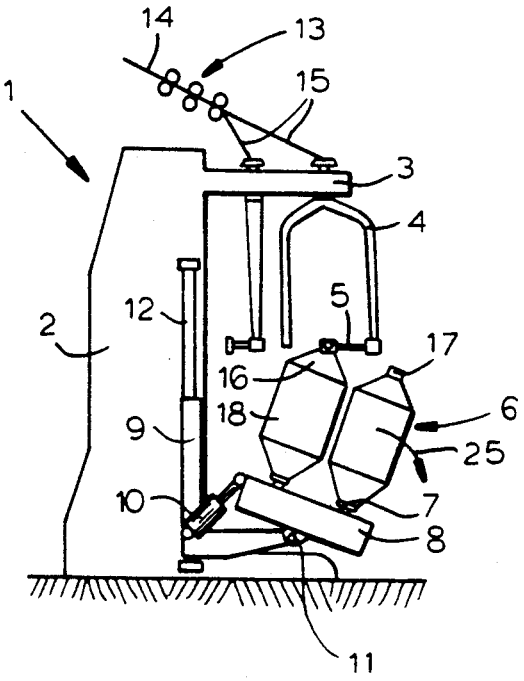

During normal use the motor 32 operates the various sets of rollers of the drawing frame 13 to pull roving or sliver 14 from unillustrated cans, stretch it, and feed it as roving 15 to the flyers 4. The relative rotation of the flyers 4 and spindles 7, effected by the drives 30 and/or 31, winds the rovings 15 onto the cores 17. The controller 28 operates the actuator 29 to shorten the vertical stroke of the packages 6 with each stroke so that the roving 15 is wound on the spools 7 in turns forming successive layers 20 which each are shorter at both top and bottom than the underlying layers and the resultant package 6 has the illustrated cylindrical central portion 18 and frustoconically shaped upper and lower ends 16. When a package 6 is complete the entire bank 8 can be tipped out in direction 25 as indicated in FIG. 6 to doff the full packages. This is all standard.

According to the invention once the package 6 is at the desired size its rotation is stopped and the drive motor 32 for the drawing frame 13 also stops so that no more filament 15 is delivered to the spinning station. The finger 5 of the flyer 4 stops on the cylindrical central portion 18 of the package 6, here in its lower third although it can in fact stop at any location.

Figure 2:
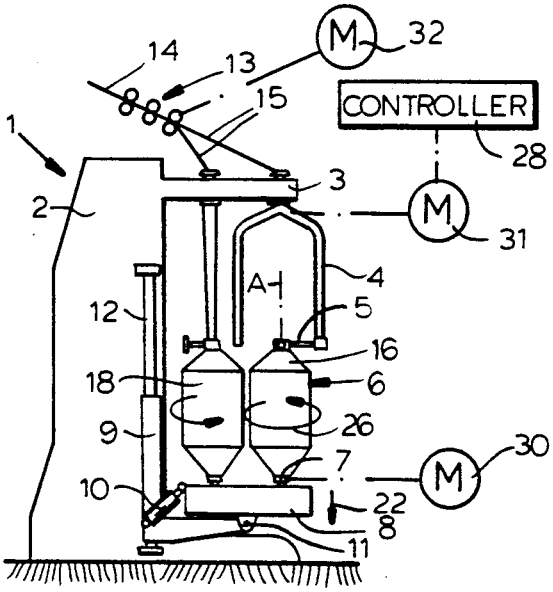

Subsequently as seen in FIG. 2 the actuator 29 drops the package 6 downward in direction 22 while the drive 30 reverse rotates the package 6 as indicated by the arrow 26. The amount of reverse rotation is dependent on how much roving must be unwound from the package 6 in order to compensate for the drop of the package 6, as upstream the roving 15 is held stationarily by the nonrotating drawing frame 13. In other words the package 6 is reverse rotated enough to unwind at least an amount of the roving 15 equal to the vertical drop of the package 6. Meanwhile the flyer 4 remains stationary. The packages 6 are moved downward until the fingers 5 are above the cylindrical middle regions 18 of the packages 6, actually above all the roving on the packages 6 but not above the upper ends of the cores 17.

Figure 3:
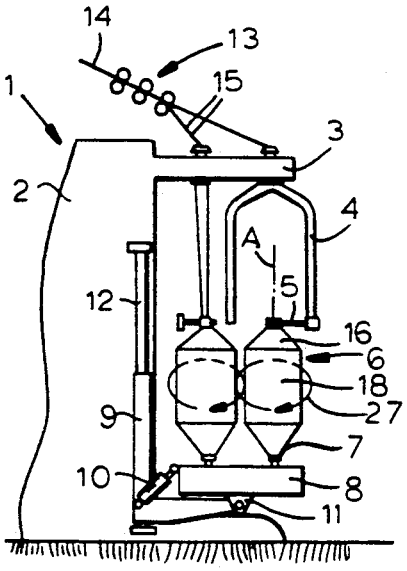

FIG. 3 shows how the spindles 7 are then rotated forward in the direction 27 so that a few turns of the roving 15 are wound around the upper end 16 of the package 6 or the exposed upper end of the sleeve 17. In cases with roving that clings to itself a half revolution in the direction 27 is frequently sufficient.

Figure 4:
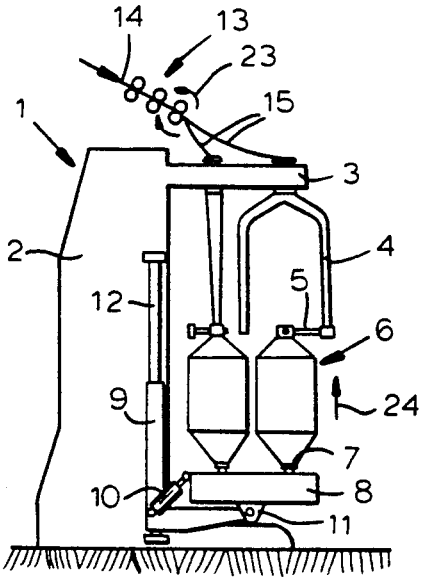

In the next step as shown in FIG. 4 the drawing frame 13 is rotated forward as shown by arrows 23 to deliver more roving 15 to the packages 6. Simultaneously the spindle bank 8 is raised by the actuator 29 as shown by arrow 24.

Figure 5:
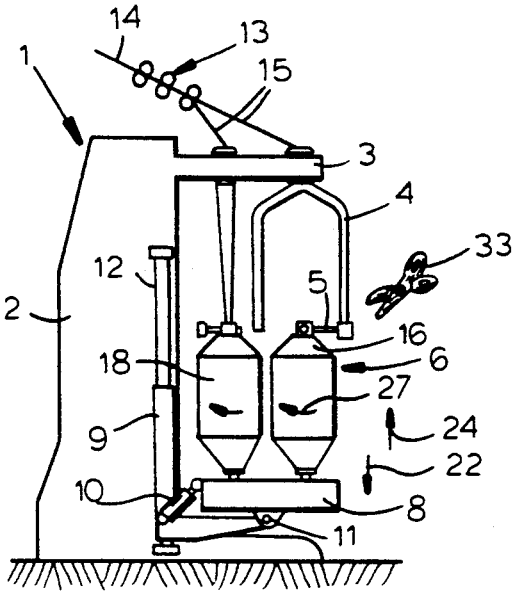

The tension created in the filament 15 in the FIG. 4 step is relieved to avoid problems with the last-applied layer 20 of roving as seen in FIG. 5 by rotating the packages 6 forward through at least 5° as shown by arrow 27. Meanwhile the frame 13 is stopped. This lifting action, which may be coupled with more forward rotation of the package 5, typically ruptures or severs the filament 15, although it is possible to employ means as illustrated schematically at 33 in FIG. 5 for this purpose.

Then the entire spindle bank 8 is tipped out in direction 25 as seen in FIG. 6 and the full package is doffed.

Figure 7:
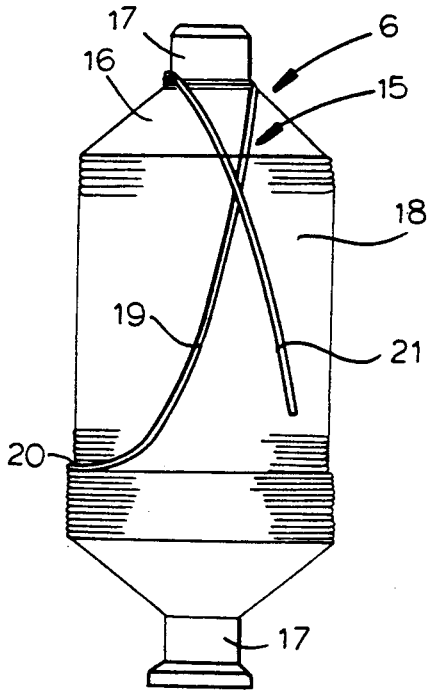
FIG. 7 is larger-scale side view of a roving package with its trailing end looped according to this invention.

The full packages will therefore have as seen in FIG. 7 a roving end 19 that extends from the end of the last-applied layer 20 up over the cylindrical portion 18 to the upper tapered end 16 to wind about it or about the spindle 17 in several turns (although less than one full turn is within the scope of the invention) and then drops down as a free end 21 that lies against the side of the package 6. This free end 21 is extremely easy to catch, yet the roving 15 is effectively prevented from unwinding.

I claim:

1. A method of operating a spinning apparatus for winding a roving onto a roving package wherein roving is fed to a flyer, the package is rotated in a forward direction about an upright axis, the roving is wound in a succession of turns around the package from a radial innermost first layer to a radial outermost last layer by a flyer finger movable axially relative to the package, and the package and the flyer are relatively vertically displaced such that each successive layer of turns has an upper end that is below the upper end of the preceding layer to impart to the finished package an axially upwardly tapered upper end portion, the method comprising the steps after substantially completely forming the package of sequentially:

a) stopping the drive for the relative rotation of the flyer and the package about the axis, stopping feed of the roving, and stopping the flyer in a position with the finger underneath the upper end of the last layer of turns formed on the package;

b) lowering the package until the finger is above the upper end of the last layer of the turns formed on the package while rotating the package in a reverse direction opposite to the forward direction without feeding more roving to the package;

c) rotating the package in the forward direction through at least one half revolution about the axis without feeding more roving to the package so as to form at least a partial loop of the roving around the package above the upper end of the last layer of the turns;

d) feeding more roving to the package while lowering the package until the finger is below the upper end of the last layer of the turns; and e) raising the package and severing the roving upstream of the package.

2. The method defined in claim 1, further comprising after step d) the step of:

f) rotating the package in the forward direction through at least 5°; and g) tipping the package outward into a doffing position.

* * * * *